US005881613A

United States Patent [19]

Han

[11] Patent Number: 5,881,613

[45] Date of Patent: Mar. 16, 1999

[54] SCREWDRIVER HAVING DISENGAGING MECHANISM

[76] Inventor: Ki Su Han, 2249 Lerona Ave., Roland Heights, Calif. 91748

[21] Appl. No.: 832,806

[22] Filed: Apr. 4, 1997

[51] Int. Cl.[6] ..... B25B 23/00

[52] U.S. Cl. ..... 81/429; 81/469; 408/241 S

[58] Field of Search ..... 81/429, 469; 408/241 S

[56] References Cited

U.S. PATENT DOCUMENTS

| | | | |
|---|---|---|---|
| 4,647,260 | 3/1987 | O'Hara et al. | 81/429 X |
| 4,809,572 | 3/1989 | Sasaki | 81/429 |
| 5,682,800 | 11/1997 | Jore | 81/429 |

*Primary Examiner*—James G. Smith

[57] ABSTRACT

A screwdriver of the present invention is designed for use with power tools. The screwdriver provides an automatic disengagement mechanism to prevent excess penetration of the screw into a work surface. The screwdriver has a housing enclosing the motor and a bracing member inserted into the housing, in which the bracing member is shaped to slide inside the housing. A sleeve member adjustably secured to the bracing member so that when the sleeve member is in a fully extended position in relation to the bracing member the spindle containing a driver bit is engaged to the motor through a transmission assembly, such as clutches or ball bearings. Alternatively, if the sleeve member is in a retracted position, then the spindle is disengaged from the motor thus stopping the rotation of the screw even if the motor is still rotating.

17 Claims, 8 Drawing Sheets

SCREWDRIVER HAVING DISENGAGING MECHANISM

BACKGROUND OF THE INVENTION

1. Field of the Invention

This invention relates to a power screwdriver, and more particularly, to a transmission mechanism, such as clutches or ball bearings, built into the screwdriver for disconnecting rotating force from a motor to a driver bit.

2. Description of Related Art

A conventional power screwdriver is commonly used for driving a fastener, such as a screw, into various work surfaces. Such power screwdrivers do not provide a means for automatically stopping the rotation of a spindle which holds a driver bit. To use such a power screwdriver, an operator must know when to stop applying power to the motor with a trigger switch to stop the rotation of the motor. However, when a screw is driven into a delicate material, such as dry walls, a delay in disconnecting power to the motor may damage the work surface or may result in an excessive penetration of the screw into the work surface.

Some power screwdriver is equipped with a clutch mechanism to either transmit or disconnect the rotation force from the driver motor to the spindle. The clutch mechanism includes a fixed clutch connected to the driver motor and a movable clutch which engages or disengages the fixed clutch in response to the pressure applied to a housing surrounding the driver bit when the housing is pressed against the work surface. During the disengaging operation, the separation of the clutches is usually abrupt and causes early wear of gear teeth. Similarly, when two clutches reengage each other, the gears or teeth of two clutches grind against each other to foster early wear.

SUMMARY OF THE DISCLOSURE

It is an object of the present invention to provide a screwdriver with either a clutch or a disengaging mechanism that allows smooth engagement and disengagement of the driver motor with the spindle to reduce wear and tear.

According to a first embodiment of the present invention, the screwdriver includes a housing enclosing the motor and a bracing member slidably inserted into the housing and being axially movable for a fixed distance. The screwdriver also includes a sleeve member adjustably secured to the bracing member so that the sleeve member maintains one of engagement and disengagement positions depending on an axial position of the sleeve member with respect to the housing. There also provided is a spindle for releasably mounting a driving bit and a first clutch mounted on a front portion of the gear assembly. The first clutch is rotatably supported in the housing and is axially movable in response to the movement of the bracing member. A second clutch is rotatably supported in the housing and has first and second ends. The first end is releasibly coupled to the first clutch and the second end is coupled to the spindle. The first and the second clutches engage when the sleeve member is at the engagement position and disengage when the sleeve member is at the disengagement position.

The bracing member of the above embodiment includes a plurality of indents formed on an outer body of the bracing member. As a result, a penetration depth of the screw in relation to the work surface is responsive to the position of the sleeve member on one of the plurality of indents. The sleeve member includes a bearing to engage one of the plurality of indents.

Moreover, the gear assembly includes a main gear connected to an auxiliary gear sharing a shaft. The main gear is rotatably coupled to the motor and the second gear is coupled to the first clutch. The first clutch includes first inner teeth for engaging the auxiliary gear of the gear assembly and second inner teeth for engaging the second clutch. The auxiliary gear of the gear assembly includes a top portion configured to snugly fit the first inner teeth of the first clutch when the sleeve member is at the engagement position and a bottom portion configured to loosely fit the first inner teeth of the first clutch when the sleeve member is at the disengagement position.

The gear assembly has a shaft sufficiently long to extend to and releasibly clamped within the second clutch so that when the first clutch disengages the second clutch while the sleeve member is in contact with the work surface, the shaft rotates within the second clutch while the second clutch stops rotating. When the first clutch engages the second clutch by the sleeve member being in the first position, the clamping force of the second clutch on the shaft is sufficient to allow the shaft and the second clutch to rotate at the same rate as the first clutch.

According to a second embodiment of the present invention, the screwdriver includes a housing, an inner spindle for releasibly mounting a driver bit, an outer spindle rotatably supported within the housing and coupled to the motor. The outer spindle has a hollow interior for rotatably supporting the inner spindle. The screwdriver further includes a bracing member slidably inserted onto and supported by the outer spindle and securely coupled to the housing and a sleeve member adjustably secured to the bracing member so that the sleeve member maintains one of engagement and disengagement positions depending on an axial position of the sleeve member with respect to the outer spindle. In addition, there provided a first bearing slidably positioned on and supported by the inner spindle and situated between the inner and the outer spindles so that the first bearing axially slides along the inner spindle in response to the axial position of the sleeve member with respect to the outer spindle. The first bearing engages the inner and the outer spindles to rotate at the same rate when the sleeve member assumes the engagement position. The first bearing disengages the inner and the outer spindle to prevent the inner spindle from rotating when the outer spindle rotates when the sleeve member assumes the disengagement position.

The inner spindle includes a first bearing receiving portion having a flat surface adjacent to a curved surface. When first bearing is positioned on the flat surface, the inner and the outer spindles are engaged to rotate at the same rate. When the first bearing is positioned on the curved surface, the outer spindle rotates independent of the inner spindle. The inner spindle further includes a bump between the flat surface and the curved surface. The bump is shaped to allow the movement of the first bearing from the flat surface to the curved surface only when a sufficient axial pressure is applied to the sleeve member.

These and other aspects, features and advantages of the present invention will be better understood by studying the detailed description in conjunction with the drawings and the accompanying claims.

BRIEF DESCRIPTION OF THE DRAWINGS

A detailed description of embodiments of the invention will be made with reference to the accompanying drawings, wherein like numerals designate corresponding parts in the several figures.

DETAILED DESCRIPTION OF THE PREFERRED EMBODIMENTS

Figure 1:
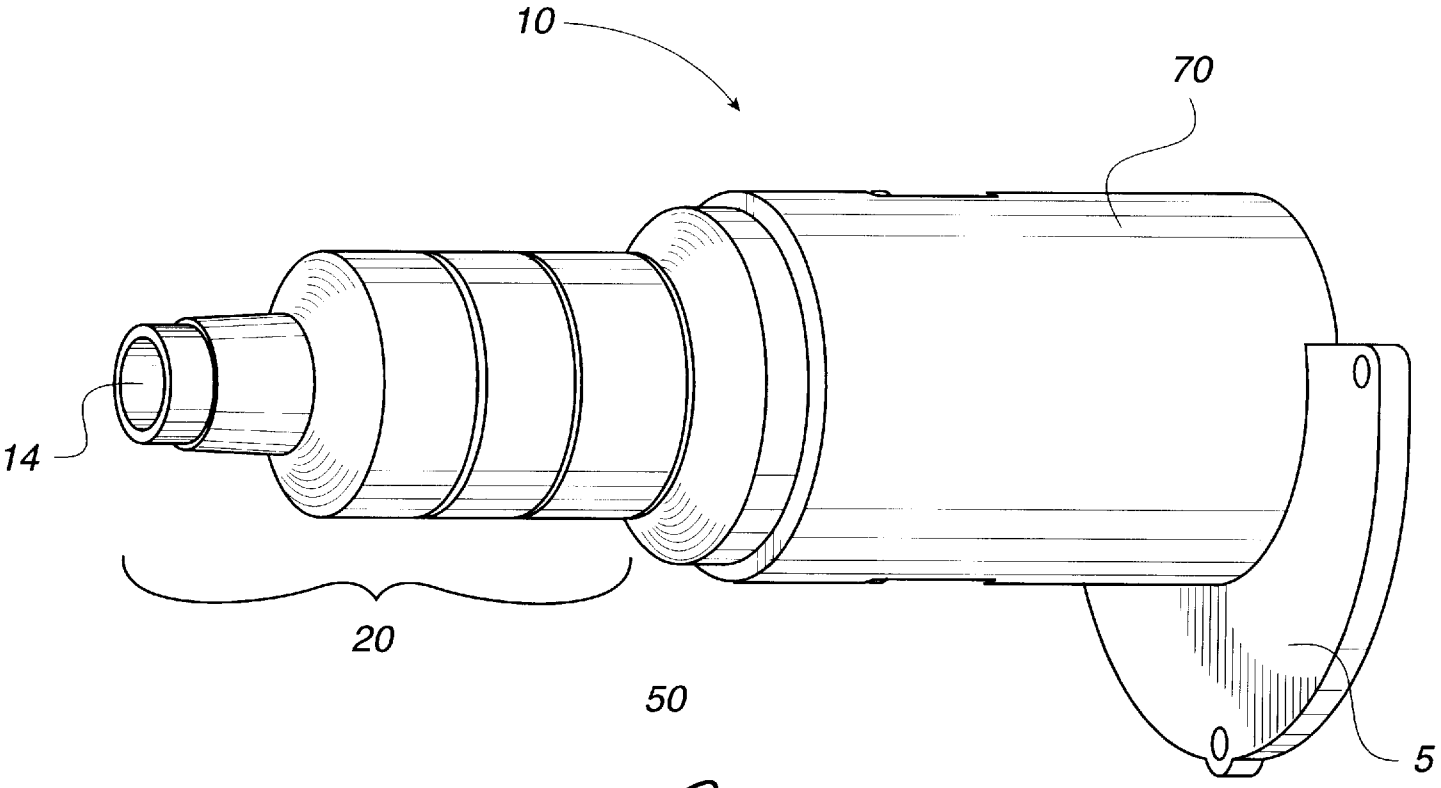
FIG. 1 is a perspective view of a first embodiment of the present invention.

Various embodiments of the power screwdriver with a clutch assembly or a disengaging mechanism according the present invention are shown in the drawings for purposes of illustration. The screwdriver according to the present invention is designed to be used with a power tool, but may be modified to be used with hand tools, such as conventional screwdrivers.

Figure 2:
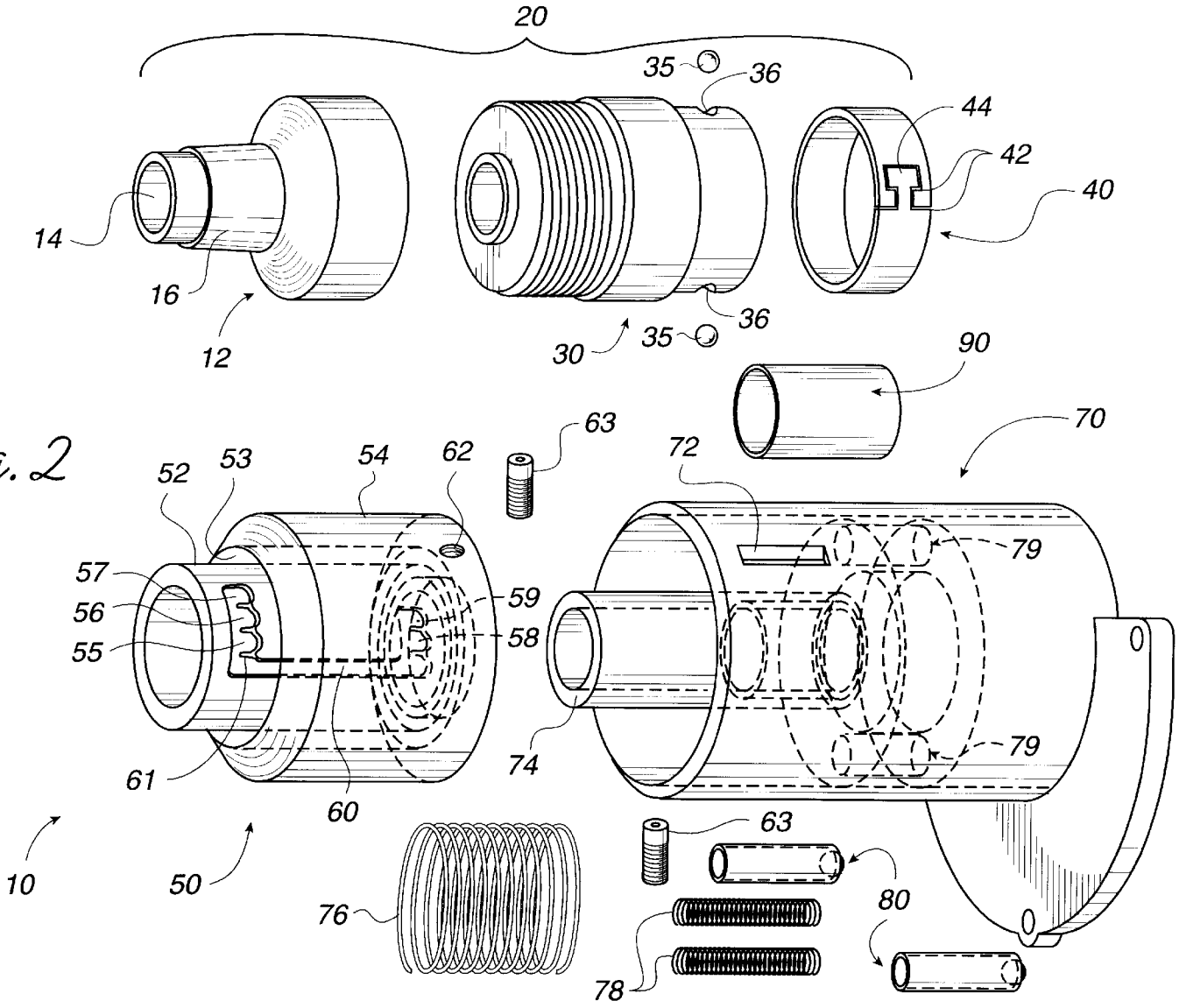
FIG. 2 is an exploded view of FIG. 1.
Figure 3:
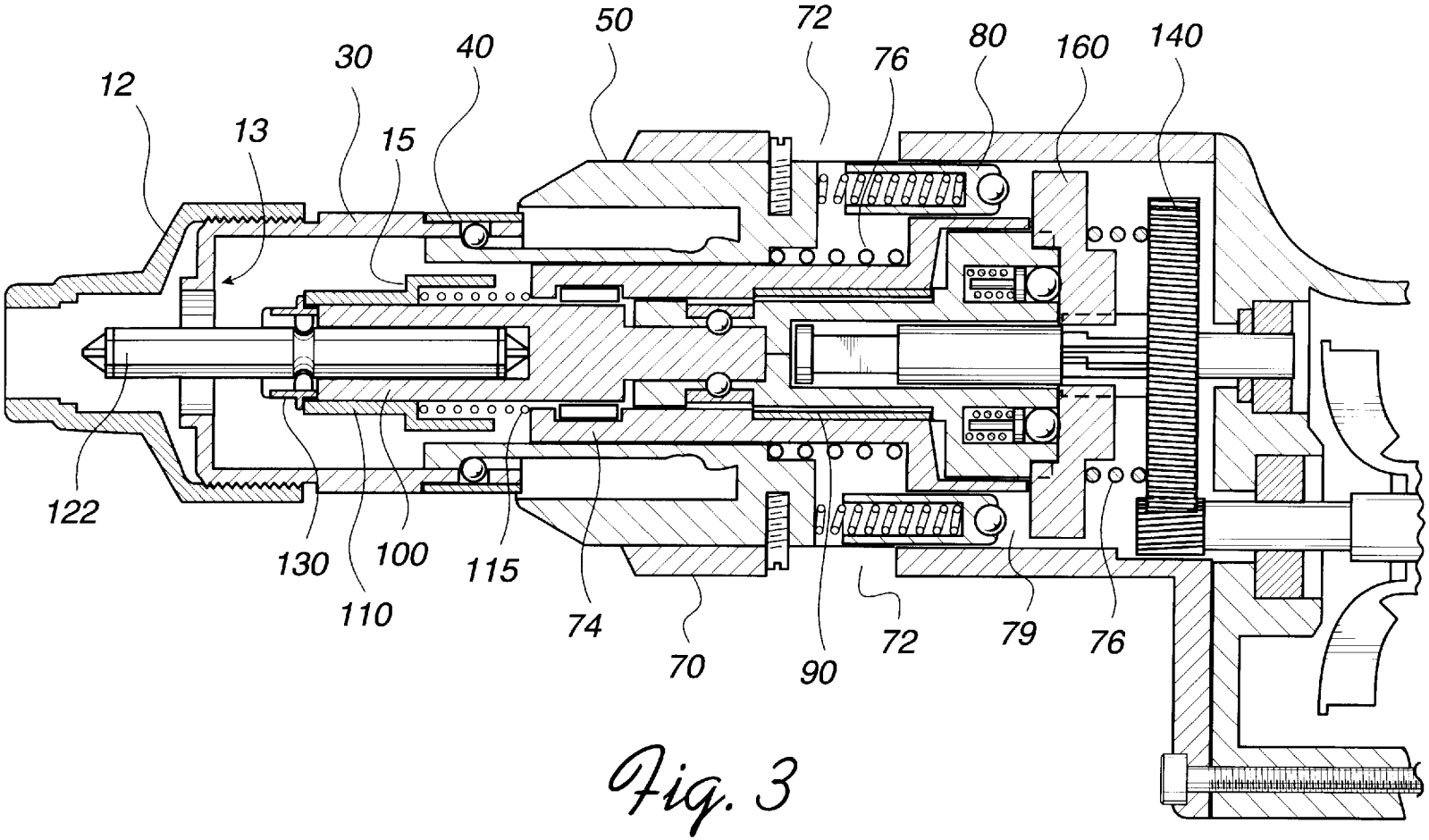
FIG. 3 is a cross-sectional view of FIG. 1.
Figure 4:
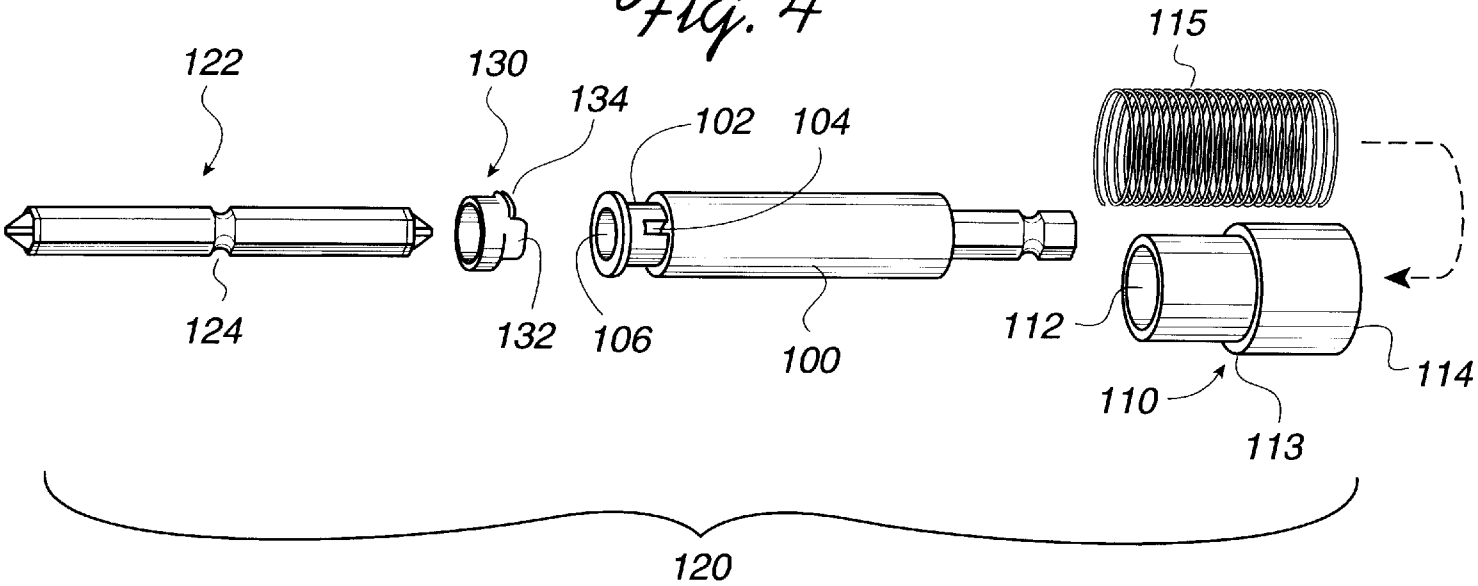
FIG. 4 is an exploded view of a spindle assembly of the first embodiment of the present invention.
Figure 5:
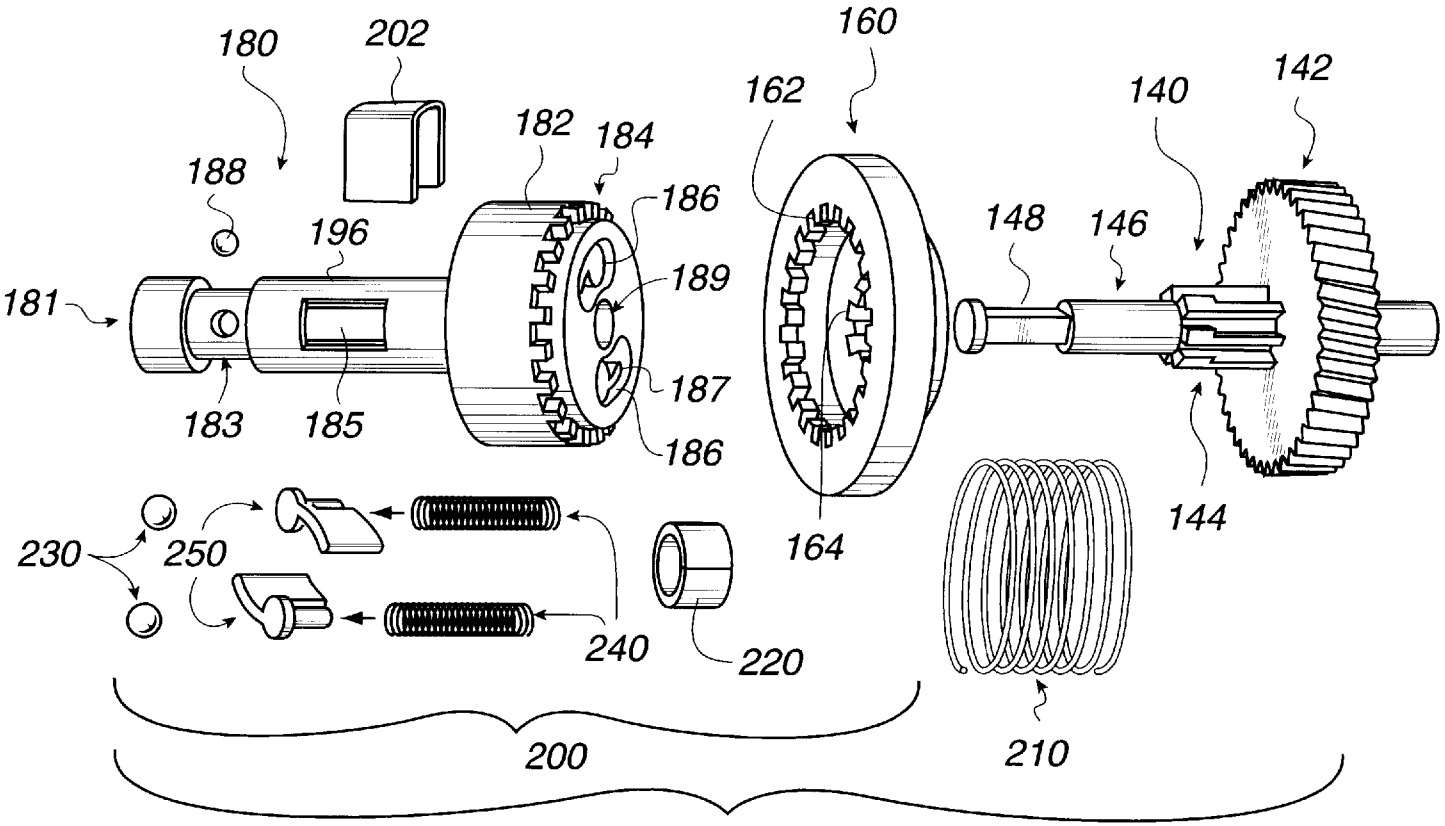
FIG. 5 is an exploded view of a clutch assembly of the first embodiment of the present invention.

FIGS. 1–5 illustrate a first embodiment of the screwdriver 10. FIG. 1 illustrates a perspective view of the screwdriver 10 which is ready to be mounted to a driver motor (not shown) through a mounting plate 5. The screwdriver 10 includes a sleeve member 20, a bracing member 50, a housing 70, a spindle assembly 120 (FIG. 4) and a clutch assembly 200 (FIG. 5). An opening 14 formed in the front of the sleeve member 20 is for inserting the head portion of a screw to engage the driver bit 122 (FIG. 3).

As shown in FIG. 2, the sleeve member 20 includes a stopper sleeve 12, a sleeve body 30 and a band 40. The stopper sleeve 12 has a cylindrical spout 16 in the front end for inserting a screw into the opening 14 and is threadably secured to the front end of the sleeve body 30. The projection of the stopper sleeve 12 is adjusted by controlling the threading depth of the stopper sleeve 12 in relation to the sleeve body 30. The adjustment of the threading depth controls the penetration depth of a screw into a work surface. For example, if the stopper sleeve 12 is completely threaded into the front end of the sleeve body 30, then the penetration depth of a screw into a work surface will be deeper. Conversely, if the stopper sleeve 12 is partially threaded into the front end of the sleeve body 30, then the penetration depth of a screw into a work surface will be shallower.

Also shown in FIG. 2 is a ring 40 configured for mounting on the other end of the sleeve body 30. The ring 40 is substantially cylindrical and is made of a rigid material, such as steel. The ring 40 is preferably formed with an elongated rectangular strip having a T-shaped extrusion 44 and equally shaped receptacle. In the preferred embodiment, the T-shaped receptacle is slightly larger than the T-shaped extrusion 44 by a gap 42 to allow the ring 40 to slightly expand in its diameter in response to the outward movement of the ball bearings 35. The ball bearings 35 are inserted into each respective receptacle 36 which is formed substantially in opposite location of each other. The cross-sectional illustration showing the placement and arrangement of the ball bearings 35 is better illustrated in FIG. 3.

There is also provided in FIG. 2 a bracing member 50 having a cylindrical inner member 52 and a cylindrical outer member 54 integrated into a single piece member. A cylindrical void 53 formed between the inner member 52 and the outer member 54 is configured for slidably mounting the sleeve member 20. In particular, the sleeve body 30 coupled with the ring 40 is slidably inserted into the cylindrical void 53. When properly inserted, the ball bearings 35 engage and rest in one of the indents 55, 56, 57, 58 or 59. A track 60 is formed between the indents 55–59 for guiding the movement of the ball bearings 35. Indents 55–57 are used to adjust the desired depth of the screw before the clutches disengage. Indent 58 may be selected to use the screwdriver 10 without the help of the clutch assembly, for example, to unscrew the embedded screw. Indent 59 is used to replace a driver bit 122. Although not shown in FIG. 2, the identical track 60 and the indents 55–59 are formed on the opposite side of the inner member 52. Between individual indents 55–59, there provided a bump 61 to hold the ball bearing 35 into a designated indent. However, the height of the bump 61 is such that a sufficient twisting force applied to the sleeve body 30 will allow the ball bearing 35 to travel to adjacent indents.

In the preferred embodiment of the present invention, the outer member 54 has a pair of threaded receptacles 62 (only one shown in FIG. 2, but both are shown in FIG. 3) configured for receiving mounting screws 63. The mounting screws 63 are inserted into respective threaded receptacles 62 when the bracing member 50 is slidably inserted into a cylindrical hole formed between the body of the housing 70 and a spindle guide 74. In particular, the mounting screws 63 are threaded into the threaded receptacles 62 when the threaded receptacles 62 are aligned with windows 72. In other words, the mounting screws 63 are inserted through the windows 72 and then securely mounted into the threaded receptacles 62 with a portion of screws 63 protruding from the bracing member 50 so that the movement of the bracing member 50 is restricted to the opening defined by the windows 72 formed in the housing 70.

The arrangement of the internal components of the screwdriver 10 is now explained in reference to FIG. 3 which illustrates a cross-sectional view of a preferred embodiment of the present invention. In the preferred embodiment, there provided in the interior of the housing 70 a bracing member coil 76 inserted around the spindle guide 74 and positioned between the bracing member 50 and the bottom wall of the spindle guide 74 to resist against a pressing movement of the bracing member 50 toward the bottom wall of the spindle guide 74. A pair of press cylinders 80, each having a ball bearing rotatably embedded or secured to one end and a hollow hole on the other end, are placed on the outer perimeter 79 of the spindle guide 74 substantially opposite of each other, as shown in FIG. 3. Each press cylinder 80 has inside a press coil 78 which rests against the bottom wall of the bracing member 50 to provide a resistive force against the bracing member 50 when the bracing member 50 is axially pressed toward the bottom wall of the spindle guide 74.

FIG. 4 illustrates the spindle assembly 120 according to the preferred embodiment of the present invention. The spindle assembly 120 includes a spindle 100, a bit coupler 130, a spindle coil 115 and a spindle sleeve 110. As shown in FIG. 3, the spindle 100 is inserted into an axial opening 181 defined by the clutch assembly 200 through a center opening of the spindle guide 74. In particular, the lower end of the spindle 100, which has an angled surface having, for example, a hexagonal cross-section, is inserted into the correspondingly configured axial opening 181 of the clutch assembly.

Once the spindle 100 is inserted into the axial opening, the spindle coil 115 is placed around the spindle 100 and abuts against the top surface of the spindle guide 74 (shown in FIG. 3). Thereafter, the spindle 100 and the spindle coil 115 are inserted into the spindle sleeve 110 having a cylindrical opening. As shown in FIG. 4, the spindle sleeve 110 has a first opening 112 which is smaller in diameter than that of a second opening 114. The first opening 112 is sufficiently large to snugly fit the spindle 100 therein. Conversely, the second opening is sufficiently large to accommodate the spindle coil 115, as shown in FIG. 3. One end of the spindle coil 115 rests on the shoulder 113 created by the connecting region of the first opening 112 and the second opening 114. The driver bit 122 is then placed inside an opening 106. The opening 106 is formed axially along the length of the spindle 100 for receiving a driver bit 122 and is configured to have an angled inner surface, such as hexagonal, to receive a similarly shaped driver bit 122 without any slippage. After the driver bit 122 is inserted, the bit coupler 130 is mounted onto the neck member 102 of the spindle 100.

The top potion of the spindle 100 has a neck member 102 which has a smaller outer diameter and is configured to receive the bit coupler 130. Once the bit coupler 130 is mounted onto the neck member 102, a flexible indent 132 formed in the interior of the bit coupler 130 protrudes through the opening 104 formed on the neck member 102, as shown in FIG. 4. As a result, the indent 132 protrudes out of the interior wall of the cylindrical opening 106, thus firmly engaging a receptor ring 124 which is formed substantially around the driver bit 122. In the preferred embodiment, the bit coupler 130 has two oppositely placed shoulders 134 (only one is shown in FIG. 4) for restricting the movement of the spindle sleeve 110 and two indents 132 (only one is shown in FIG. 4, but both are shown in FIG. 3) to releasably hold the driver bit 122.

To either install or release the driver bit 122 from the spindle 100, the sleeve member 20 (shown in FIG. 2) is moved to the indent 59 of the bracing member 50. In that event, a groove 13 (see FIG. 3) of the sleeve body 30 pushes the spindle sleeve 110 at point 15 toward the spindle guide 74, thus allowing the indents 132 to extend outward to release the driver bit 122 from the spindle 100.

FIG. 5 illustrates the clutch assembly 200 of the present invention. The clutch assembly 200 is provided between the gear member 140 (FIG. 3) and the spindle 100. The clutch assembly 200 includes a first clutch 160 and a second clutch 180, in which the first clutch 160 is formed on the forward surface of the main gear 142.

The gear member 140 includes a main gear 142 and an auxiliary gear 144 formed on the forward surface of the main gear 142. The auxiliary gear 144 has gear teeth which have a wider thickness on the top and a narrower thickness on the bottom in which the transition between the top and the bottom is sloped. The gear teeth of the auxiliary gear 144 are configured to engage the first inner teeth 164 of the first clutch 160. The main gear 142 and the auxiliary gear 144 have a common shaft 146. In the preferred embodiment, the shaft 146 has a neck member 148 having a substantially square cross-section.

Also shown in FIG. 5 is the first clutch 160 having the second inner teeth 162. The second inner teeth 162 forms a larger diameter than that of the first inner teeth 164 and is configured to engage the second clutch 180. The first clutch 160 has a cylindrical plate-like shape.

The second clutch 180 shown in FIG. 5 has a large cylindrical portion 182 having an outer teeth 184 for engaging the second inner teeth 162 of the first clutch 160. The second clutch also has an elongated cylindrical body 196 with a neck portion having a receptor 183 for receiving an engaging ball 188. Once the engaging balls 188 (only one is shown in FIG. 5, but the preferred embodiment has at least two engaging balls 188 and corresponding receptors 183, as shown in FIG. 3) are inserted into the receptors 183, a neck sleeve 220 is placed around the neck portion to hold the engaging balls 188 in the receptors 183. The receptors 183 are sized and configured to hold the engaging balls 188 and to partially protrude a portion of the engaging balls 188 toward the inner opening. The neck sleeve 220 is made of a resilient material or is axially cut to allow it to be expanded when the engaging balls 188 are pushed outward. As described above with respect to the spindle assembly 120, the elongated cylindrical body 196 has an opening for receiving the lower portion of the spindle 100. The elongated cylindrical body 196 also has a rectangular window 185 for receiving a clip 202.

The second clutch 180 engages the first clutch 160, and the shaft 146 of the gear member 140 is inserted into a center opening 189 axially formed in the second clutch through the opening defined by the first inner teeth 164. When the shaft 146 is properly inserted, the neck member 148 is aligned with the rectangular opening 185 of the second clutch 180. The clip 202 is then inserted into the rectangular opening 185 to firmly hold the neck member 148. The clip 202 may be made of any suitable resilient material, such as plastic. A clutch coil 210 is provided between the first clutch 160 and the gear member 140 and is adapted to normally urge the first clutch 160 in a direction away from the gear member 140.

Referring further to FIG. 5, there provided in the large cylindrical portion 182 of the second clutch member 180 is a pair of receptacles 186 each configured to receive a ball bearing 230 supported by a push pin 250 which is supported by a spring 240. The cross-sectional view of the above arrangement is better shown in FIG. 3. Each receptacle 186 has a sloped surface 187. Similarly, the push pins 250 have the sloped surface corresponding to the sloped surface 187 of the receptacles 186.

The operation of the screwdriver according to the first embodiment is discussed below. After the desired depth adjustment has been made by adjusting the stopper sleeve 12 with respect to the sleeve body 30, the tip of the driver bit 122 is applied to the head of a screw (now shown), and the screw is positioned on the work surface. At this point, the first inner teeth 164 of the first clutch 160 is positioned on the upper portion of the auxiliary gear 144. The second clutch 180 is also engaged with the second inner teeth 162 of the first clutch 160. In this position, the ball bearings 230 are positioned on the lower portion of the sloped surface of the receptacles 186. As a result, when the driver motor rotates, the first 160 and the second 180 clutches are synchronously rotated which in turn rotates the spindle 100 containing the driver bit 122.

When the stopper sleeve 12 makes a contact with the work surface, the stopper sleeve 12 is gradually pulled backwards. The backward movement of the stopper sleeve 12 causes the bracing member 50 and the press cylinders 80 to be moved backwards until the ball bearings in the press cylinders 80 push the first clutch 160 away to force the disengagement from the second clutch 180. In effect, when the screw is completed embedded into the work surface, the first clutch 160 is completely disengaged from the second clutch 180. Once the first clutch 160 separates from the second clutch 180, the first inner teeth 164 rests on the lower portion of the auxiliary gear 144 of the gear member 140 (shown in FIG. 5). Because the first clutch 160 is separated, the ball bearing 230 which is supported by a push pin 250 gradually moves up the sloped surface 187 of the receptacles 186.

Because the first clutch 160 is separated from the second clutch 180, the shaft 146 of the gear member 140 rotates while the second clutch 180 does not. As a result, the neck member 148 held by the clip 202 is rotated against the clamping force of the clip 202 thus making a clamping sound. This sound is a notice to the operator that the clutches are no longer engaged.

As the operator removes the screwdriver 10 from the work surface, the clip 202 around the neck member 148 forces the first clutch 160 and the second clutch 180 to align properly so as to engage each other without causing grinding and gear teeth wear.

Figure 6:
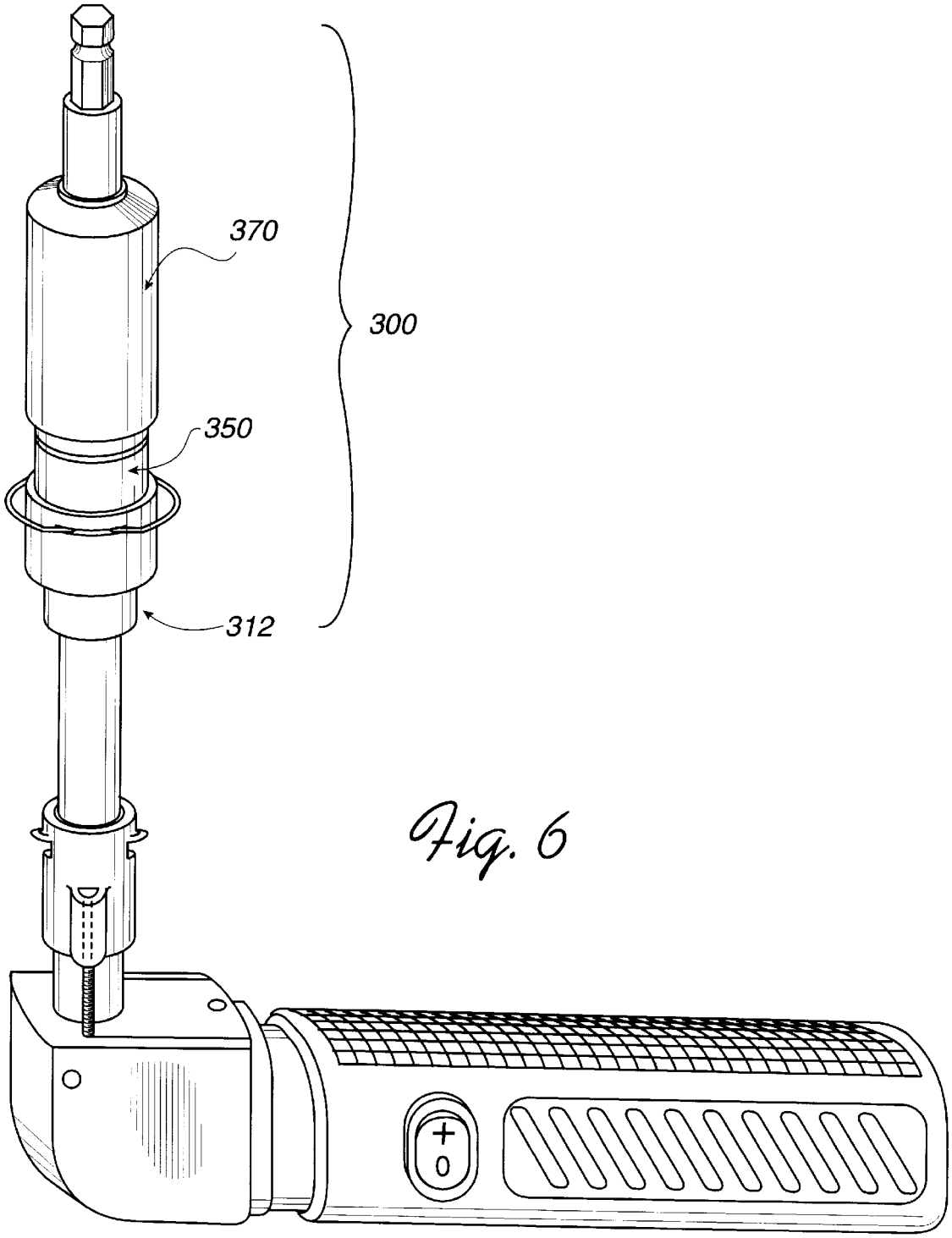
FIG. 6 is a perspective view of a second embodiment of the present invention.
Figure 7:
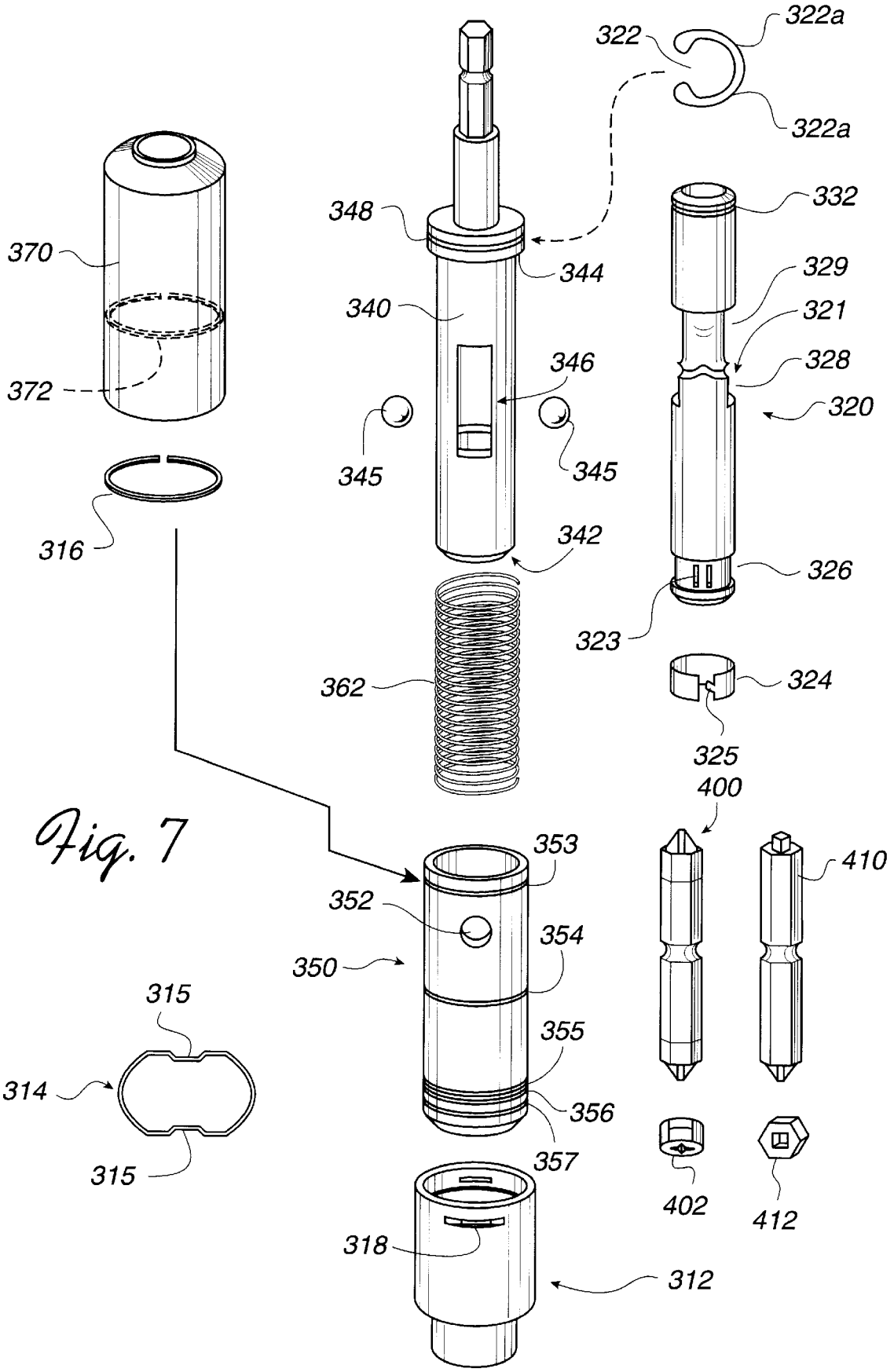
FIG. 7 is an exploded view of FIG. 6.
Figure 8:
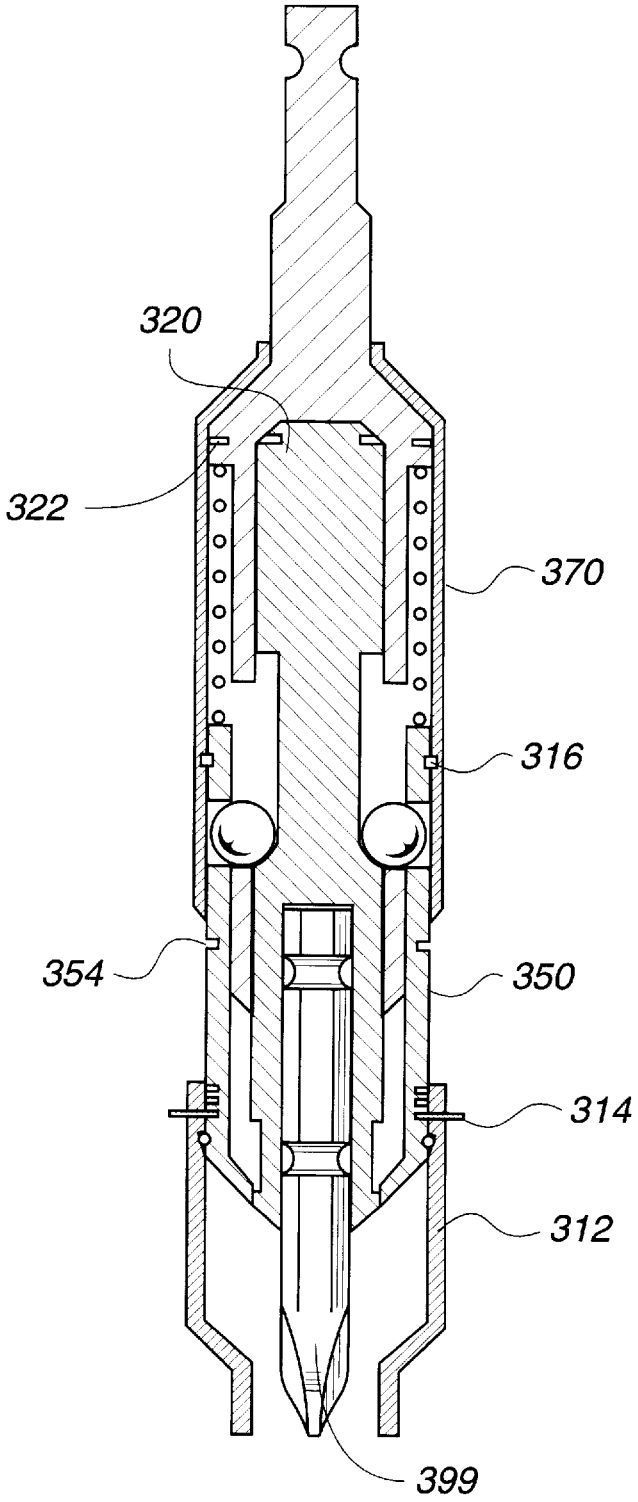
FIG. 8 is a cross-sectional view of FIG. 6.

FIGS. 6–8 illustrate a second embodiment of the screwdriver 300. The second embodiment shown in FIG. 6 includes a stopper sleeve 312 slidably coupled to the front end of a bracing member 350 and a housing 370 which is slidably coupled to the near end of the bracing member 350.

FIG. 7 shows an exploded view of the components making up the second embodiment of the present invention, which includes an inner spindle 320 having a neck member 326 for mounting a brace 324. An extension 325 formed on one end of the brace 324 is inserted into a slot 323 which is configured and formed to receive the extension 325. The extension 325 is inserted through the slot 323 to releasably engaging the driver bit. Although not shown in FIG. 7, an additional extension may be formed on the other end of the brace 324 for insertion into an additional slot formed next to the slot 323 to firmly hold the driver bit in the inner spindle 320. During operation of the screwdriver, as shown in FIG. 8, the top portion of the bracing member 350 firmly holds the brace 324 against the neck member 326 thus holding the driver bit 399 within the inner spindle 320. To replace the driver bit 399, the bracing member 350 is pulled down until the top portion of the bracing member 350 no longer makes a contact with the brace 324. This allows the brace 324 to be pushed outward when the driver bit 399 is pulled away from the inner spindle 320.

The inner spindle 320 is then inserted into an elongated cylindrical opening 342 of the outer spindle 340. The inner spindle 320 is securely coupled to the outer spindle 340 by placing a spindle washer 322 on a track 348 formed around the outer spindle 340. The spindle washer 322 has enlarged ends 322*a* which penetrate through openings (not shown) in the track 348 and engage the groove 332 formed on the inner spindle 320. The assembly of the inner spindle 320 and the outer spindle 340 is inserted into a spindle coil 362. The bottom portion of the spindle coil 362 rests on the shoulder 344 of the outer spindle 340.

As shown in FIG. 7, the inner spindle 320 further includes a bump 321 formed on the outer surface of the inner spindle 320. The bump 321 is positioned between the flat surface 328 and the curved surface 329. The bump 321 allows the movement of the engaging balls 345 from the flat surface 328 to the curved surface 329 when a sufficient pressure is applied to the sleeve member 312, i.e., when the sleeve member 312 is pressed against the work surface.

The inner spindle 320 and the outer spindle 340 assembly is slidably inserted into an opening of the bracing member 350. The bracing member 350 has a pair of receptacles 352 (only one is shown in FIG. 7, but both are shown in FIG. 8) for receiving engaging balls 345. Each receptacle 352 is aligned with a rectangular window 346 and the flat surface 328 formed on the body of the inner spindle 320 so that when the engaging balls 345 are inserted into the receptacles 352, each engaging ball 345 rests on the corresponding flat surface 328 of the inner spindle 320, as shown in FIG. 8.

The bracing member 350 also has a number of grooves formed on its outer surface of the cylindrical body. The first groove 353 is configured to be fitted with a washer 316. Once the washer 316 is in place, the housing 370 is inserted through the bottom portion of the outer spindle 340. The interior of the housing 370 also has an inner groove 372 to receive the washer 316. As a result, the bracing member 350 is securely engaged inside the housing 370 with the washer 316.

The stopper sleeve 312 is placed on the top of the bracing member 350 and held into place by a band 314. The band 314 is in the form of a rectangle with semi-circular ends and is made of a flexible but rigid material so that when pressure is applied on the semi-circular ends, the rectangular portion expands outward. This is helpful since the band 314 has a pair of opposite facing tabs 315 which engage the grooves 355–357 through a pair of slits 318 formed on the stopper sleeve 312. As a result, the position of the stopper sleeve 312 with respect to the bracing member 350 can be adjusted depending on the placement of the band 314 on one of the grooves 355–357. The above embodiments of the present invention may be used with driver bits 400 and 410 having uniquely constructed tips for used with the screws having the matching heads of 402 and 412, respectively, in FIG. 7.

The operation of the screwdriver according to the second embodiment is discussed below in reference to FIG. 8. After the desired depth adjustment has been made by adjusting the stopper sleeve 312 with respect to the bracing member 350 by adjusting the location of the band 314 with respect to the grooves 355–357, the tip of the driver bit 399 is applied to the head of a screw (now shown), and the screw is positioned on the work surface. At this point, the engaging balls 345 are positioned on the flat surfaces 328 of the inner spindle 320, as shown in FIG. 8. As a result, as the driver motor is rotated, the outer spindle 340 and the inner spindle 320 are rotated in sync, which in turn rotates the driver bit 399.

When the stopper sleeve 312 makes a contact with the work surface, the stopper sleeve 312 is gradually pulled backwards. The backward movement of the stopper sleeve 312 causes the bracing member 350 to move backwards until the engaging balls 345 on the flat surfaces 328 are pushed toward the curved surface 329 portion of the inner spindle 320. Because the curved surface 329 has a cylindrical outer surface, the engaging balls 345 no longer apply pressure on the inner spindle 320 to turn the inner spindle 320 in the same rotational direction of the main motor. This in effect stops the rotation of the driver bit 399.

As an alternative to using the above embodiment with the stopping function, the second embodiment of the present invention may also be used as a conventional screwdriver by positioning the stopper sleeve 312 near the end of the bracing member by coupling the band 314 into a middle groove 354. This allows the driver bit 399 to be exposed outside of the stopper sleeve 312. This option may be used for removing (i.e., unscrewing) embedded screws.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A screwdriver operable with a motor connected to a gear assembly for driving a screw into a work surface, the screwdriver comprising:

a housing;

a bracing member slidably inserted into the housing and being axially movable for a fixed distance;

a sleeve member adjustably secured to the bracing member so that the sleeve member maintains one of engagement and disengagement positions depending on an axial position of the sleeve member with respect to the housing;

a spindle for releasibly mounting a driving bit;

a first clutch mounted on a front portion of the gear assembly, wherein the first clutch is rotatably supported in the housing and is axially movable in response to the movement of the bracing member; and a second clutch rotatably supported in the housing and having first and second ends, in which the first end is releasibly coupled to the first clutch and the second end is coupled to the spindle, wherein the first and the second clutches engage when the sleeve member is at the engagement position and disengage when the sleeve member is at the disengagement position.

2. A screwdriver of claim 1, wherein the bracing member includes a plurality of indents formed on an outer body of the bracing member, wherein a penetration depth of the screw is responsive to the position of the sleeve member on one of the plurality of indents.

3. A screwdriver of claim 2, wherein the sleeve member includes a bearing to engage one of the plurality of indents.

4. A screwdriver of claim 1, wherein the gear assembly includes a main gear connected to an auxiliary gear sharing a shaft, wherein the main gear is rotatably coupled to the motor and (the second gear) is coupled to the first clutch.

5. A screwdriver of claim 4, wherein the first clutch includes first inner teeth for engaging the auxiliary gear of the gear assembly and second inner teeth for engaging the second clutch.

6. A screwdriver of claim 5, wherein the auxiliary gear of the gear assembly includes a top portion configured to snugly fit the first inner teeth of the first clutch when the sleeve member is at the engagement position and a bottom portion configured to loosely fit the first inner teeth of the first clutch when the sleeve member is at the disengagement position.

7. A screwdriver of claim 1, wherein the gear assembly has a shaft sufficiently long to extend to and releasibly clamped within the second clutch so that when the first clutch disengages the second clutch while the sleeve member is in contact with the work surface, the shaft rotates within the second clutch while the second clutch stops rotating, and when the first clutch engages the second clutch by the sleeve member being in the first position, the clamping force of the second clutch on the shaft is sufficient to allow the shaft and the second clutch to rotate at the same rate as the first clutch.

8. A screwdriver of claim 1, wherein the sleeve member comprises a front sleeve which is threadably secured to a sleeve body for adjusting the penetration depth of the screw.

9. A screwdriver operable with a motor for driving a screw into a work surface, the screwdriver comprising:

a housing;

an inner spindle for releasibly mounting a driver bit;

an outer spindle rotatably supported within the housing and coupled to the motor, the outer spindle having a hollow interior for rotatably supporting the inner spindle;

a bracing member slidably inserted onto and supported by the outer spindle and securely coupled to the housing;

a sleeve member adjustably secured to the bracing member so that the sleeve member maintains one of engagement and disengagement positions depending on an axial position of the sleeve member with respect to the outer spindle; and a first bearing slidably positioned on and supported by the inner spindle and situated between the inner and the outer spindles so that the first bearing axially slides along the inner spindle in response to the axial position of the sleeve member with respect to the outer spindle, wherein the first bearing engages the inner and the outer spindles to rotate at the same rate when the sleeve member assumes the engagement position, and the first bearing disengages the inner and the outer spindle to prevent the inner spindle from rotating when the outer spindle rotates when the sleeve member assumes the disengagement position, and wherein the inner spindle includes a first bearing receiving portion having a flat surface adjacent to a curved surface, in which when the first bearing is positioned on the flat surface, the inner and the outer spindles are engaged to rotate at the same rate, and when the first bearing is positioned on the curved surface, the outer spindle rotates independent of the inner spindle.

10. A screwdriver of claim 9, wherein the inner spindle further includes a bump between the flat surface and the curved surface, in which the bump is shaped to allow the movement of the first bearing from the flat surface to the curved surface only when a sufficient axial pressure is applied to the sleeve member.

11. A screwdriver of claim 9, further including a second bearing positioned on the inner spindle substantially opposite to the first bearing.

12. A screwdriver of claim 9, further including a coil slidably mounted between the outer spindle and the bracing member causing the sleeve member, which is coupled to the bracing member, to be urged into the engagement position when no axial pressure is applied to the sleeve member.

13. A screwdriver of claim 9, wherein the inner spindle includes a neck portion having a recess, and wherein the neck portion is configured to releasibly mount a brace having an extension for inserting through the recess to releasibly engage the driver bit.

14. A screwdriver of claim 9, further including a band having opposite facing tabs, wherein the sleeve member has oppositely positioned slits for fitting the tabs and the bracing member has a plurality of grooves, in which the sleeve member is adjustably positioned in relation to the bracing member by coupling the tabs to one of the plurality of grooves on the bracing member.

15. A screwdriver operable with a motor connected to a gear assembly for driving a screw into a work surface, the screwdriver comprising:

a housing;

a bracing member slidably inserted into the housing and being axially moveable for a fixed distance;

a sleeve member adjustably secured to the bracing member so that the sleeve member maintains one of engagement and disengagement positions depending on an axial position of the sleeve member with respect to the housing;

an inner spindle for releasibly mounting a driving bit; and a transmission assembly coupling the motor and the inner spindle in response to an axial pressure applied to the sleeve member, wherein the transmission assembly allows the inner spindle to engage to the motor when the sleeve member is in the engagement position and the transmission assembly allows the inner spindle to disengage from the motor when the sleeve member is in the disengagement position.

16. A screwdriver of claim 15, wherein the transmission assembly includes a first clutch coupled to the motor and a second clutch coupled to the inner spindle.

17. A screwdriver of claim 15, further including an outer spindle rotatably supported with the housing and coupled to the motor, the outer spindle rotatably supporting the inner spindle, wherein the transmission assembly includes bearings slidably positioned on and supported by the inner spindle and situated between the inner and the outer spindles so that the bearings axially slides along the inner spindle in response to the axial position of the sleeve member with respect to the outer spindle, and wherein the bearings engage the inner and the outer spindles to rotate at the same rate when the sleeve member assumes the engagement position, and the bearings disengage the inner and the outer spindle to prevent the inner spindle from rotating when the outer spindle rotates when the sleeve member assumes the disengagement position.

* * * * *